US005613731A

United States Patent [19]

Aspinall

[11] Patent Number: 5,613,731

[45] Date of Patent: Mar. 25, 1997

[54] SUN BATHING APPARATUS EMPLOYING WATER MIST DEVICES

[76] Inventor: Don Aspinall, 5942 Edinger Ave. Suite 113, Huntington Beach, Calif. 92649

[21] Appl. No.: 626,368

[22] Filed: Apr. 2, 1996

[51] Int. Cl.[6] ..... A47C 7/62; A47C 31/00

[52] U.S. Cl. ..... 297/180.15; 239/289

[58] Field of Search ..... 297/180.15; 239/289, 239/581.1, 506, 513

[56] References Cited

U.S. PATENT DOCUMENTS

| | | | |
|---|---|---|---|
| 3,625,434 | 12/1971 | Kitover | 297/180.15 |
| 4,925,099 | 5/1990 | Owen | 239/289 |
| 5,000,384 | 3/1991 | Arnold | 297/180.15 |

*Primary Examiner*—Peter R. Brown
*Assistant Examiner*—Anthony D. Barfield
*Attorney, Agent, or Firm*—Erik M. Arnhem

[57] ABSTRACT

A sunbathing apparatus includes a lounge chair equipped with six water spray nozzles at selected points along the chair surface, for generating a water mist atmosphere above the person reclining on the chair. Each spray nozzle has a tubular section extending through a rigid wall of the chair for gripment by a fastener, to achieve a rigid mounting of the spray nozzle. Water flow through the nozzles is controlled by a manual control valve connected to a flexible tube system joining the various nozzles. The valve is preferably a manually operable ball valve that can be adjusted to different settings for varying the water flow through the nozzles.

6 Claims, 2 Drawing Sheets

SUN BATHING APPARATUS EMPLOYING WATER MIST DEVICES

BACKGROUND AND SUMMARY OF THE INVENTION

This invention relates to a sunbathing apparatus, and particularly to an apparatus that comprises a lounge chair having a system of water spray nozzles for generating a cooling water mist atmosphere in the vicinity of the chair, whereby a person reclining on the chair is cooled by the water mist particles.

Lounge chairs having water mist generating devices are known in the art. The apparatus of the present invention is an improvement over the art in that the water spray nozzles have improved mounting connections with the chair, whereby the water spray patterns are predetermined and effective. Also, the apparatus of the present invention employs a manually operable control valve on the lounge chair that enables the chair occupant to vary or adjust the water flow rate, to thereby vary the spray patterns of the spray nozzles. In preferred practice of the invention there are three pairs of water spray nozzle units. One pair of nozzles is located at the foot end of the chair seat; a second pair of nozzles is located at the upper end of the chair back; a third pair of nozzles is located on the chair arm rests. The nozzle arrangement provides reasonably good coverage of the entire area above the chair, such that the chair occupant is fully exposed to the cooling water mist. Each pair of nozzles receives pressurized water through a separate flexible tube system, so that each nozzle has an adequate water supply.

Referring to the prior art, U.S. Pat. No. 4,765,542 to D. Carlson shows a lounge chair wherein an H-shaped tube system extends within the chair frame envelope to supply water to spray nozzles at spaced points along the tube system. The tube system is fastened to the chair frame by flexible ties (or wires).

U.S. Pat. No. 4, 854,502 to R. Cox shows a lounge chair having a water spray unit located above the chair seat for spraying water particles upwardly into the zone above the chair. The water spray unit is supported by means of a bracket arm that is clamped or otherwise attached to the chair frame.

U.S. Pat. No. 4,961,535, to J. Skibik shows a water spray apparatus attached to the frame of a lounge chair by two clamp arms. The spray apparatus comprises a single length of tubing having six spray nozzles spaced along the tubing length. Each spray nozzle comprises a flexible gooseneck connection that enables the spray direction to be changes (or varied).

U.S. Pat. No. 5,156,339, to K. Gibson, employs gooseneck connections at each spray nozzle, similar to the arrangement depicted in the above mentioned U.S. Pat. No. 4,961,535. In the system of U.S. Pat. No. 5,156,339, the hollow tubular frame of the lounge chair is used as a water conduit to supply pressurized water to the individual nozzles.

U.S. Pat. No. 4,548,357 to T. Schmidt, shows a lounge chair having a U-shaped flexible tube extending along the chair frame. Small openings at spaced points along the tube provide the water spray pattern. Flexible ties are used to to attach the flexible tube to the chair frame. Also, the tube is anchored to corner areas of the chair frame by means of plastic foam fittings.

U.S. Pat. No. 5,322,342, to D. Gange, shows a lounge chair equipped with a water hose that extends along and around the chair frame. Opposite ends of the hose are connected to a T fitting, whereby water is supplied to both ends of the hose. Small holes at selected points along the hose serve as spray nozzles.

In most of the prior art arrangements the spray nozzles are formed by small holes in a flexible tube, or by separate nozzles supported by a flexible tube. In such arrangements the hydrodynamic forces associated with water flow through the flexible tube can disturb the positions of the nozzles, so as to potentially adversely affect the water spray pattern. In my newly proposed arrangement, each spray nozzle is individually affixed to the chair frame, such that the nozzle position is predetermined and supported against disturbance by the water forces. Also, my proposed arrangement includes an in-line ball valve that can be manually adjusted to vary the water flow rate; the valve can be used to adjust the nozzle spray pattern or to achieve a desired spray pattern with different water supply pressures (i.e. different pressures at the household faucet).

Further features of the invention will be apparent from the attached drawings and description of a preferred embodiment of the invention.

THE DRAWINGS

DESCRIPTION OF A PREFERRED EMBODIMENT OF THE INVENTION

Figure 1:
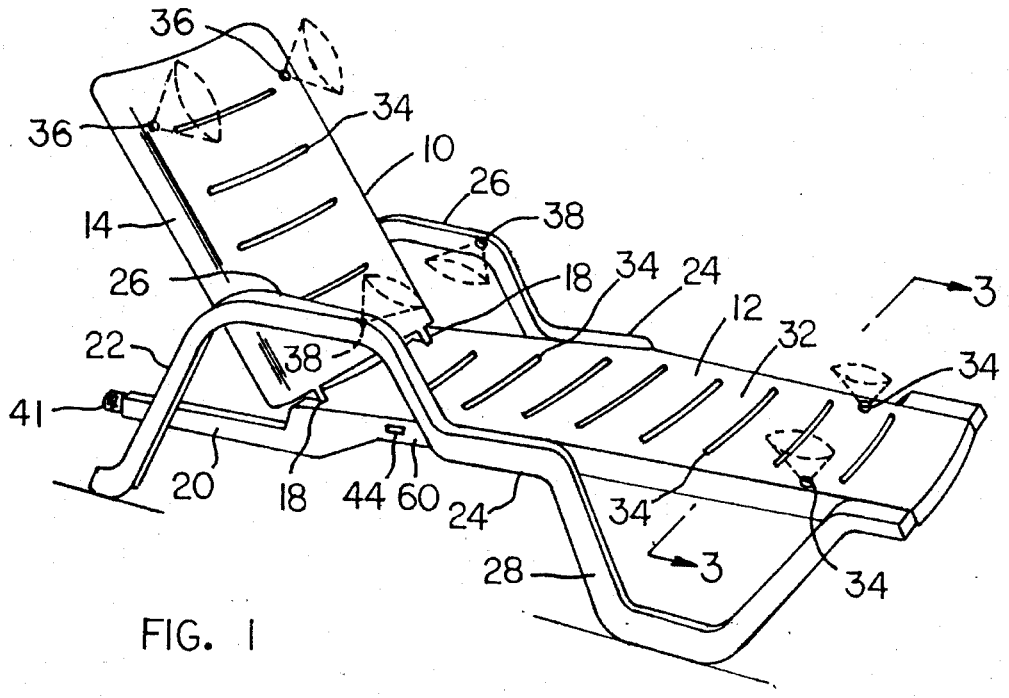
FIG. 1 is a lounge chair equipped with a water mist generating system according to the present invention.

FIG. 1 shows a conventional lounge chair 10 that includes an elongated seat portion 12 formed of a rigid plastic material, and a back portion 14 also formed of a rigid plastic material. The back portion 14 is hingedly connected to seat portion 12 by means of integral hinges, whereby the back portion can be set in an upright position, as shown in the drawing, or in a prone position (not shown) approximately in line with seat portion 12. The hinged connections between seat portion 12 and back portion 14 are indicated generally by numeral 18.

Figure 3:
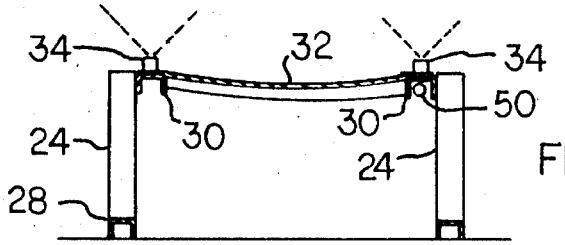
FIG. 3 is a transverse sectional view taken on line 3—3 in FIG. 1.

Seat portion 12 includes two hollow side extensions 20 that are joined to rear legs 22 (only one leg 22 is visible in FIG. 1). Each leg 22 is part of a molded plastic side frame 24 that extends forwardly alongside the seat portion 12 to form an elevated arm rest 26 and a front leg 28. Each side frame 24 is a molded plastic member having a channel cross section, as viewed e.g. in FIG. 3. The two side frames 24 are adhesively attached to side edges of seat portion 12 to form a support structure for the lounge chair.

Seat portion 12 is a rigid molded plastic member that comprises two side channels 30 (FIG. 3) extending the length of the seat portion 12, and a series of transverse molded channels 32 extending between the two side channels. The various channels are molded and joined together to form a smooth rigid upper surface for supporting the body of the chair occupant.

Back portion 14 of the lounge chair is constructed generally similarly to seat portion 12, primarily in size (length). In the drawings the slot-like spaces between the transverse molded channels in seat portion 12 and back portion 14 are denoted by numeral 34.

The invention is concerned more particularly with a water spray system incorporated into the lounge chair. The water spray system comprises two spray nozzle units 34 affixed to seat portion 12, two spray nozzle units 36 affixed to back portion 14, and two spray nozzle units 38 affixed to arm rests 26.

Figure 2:
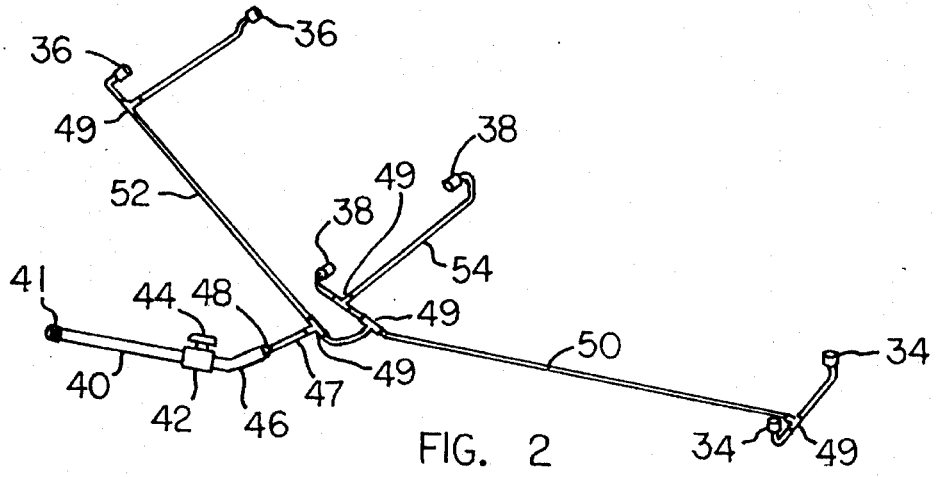
FIG. 2 is a skeletal depiction of the water distribution mechanism used in the FIG. 1 apparatus.

Each spray unit is connected to a flexible tube that forms part of the water supply means depicted in FIG. 2. In one particular arrangement the water supply system comprises a first intake hose 40 having a threaded coupling 41 for attachment to a conventional garden hose (not shown). Hose 40 is located within one of the hollow extensions 20 of seat portion 12. Hose 40 connects with a flow control valve 42, shown in FIG. 6. The manual handle for valve 42 is shown at 44 in FIG. 1. The valve housing is located underneath seat portion 12 in a concealed position (behind handle 44 in FIG. 1)

Referring to FIG. 2, control valve 42 connects with a second hose 46 that is joined to a smaller diameter flexible tube 47, via a plastic connector 48. Each hose 40 or 46 can have a diameter of about one half inch. Flexible tube 47 can have a diameter of about one quarter inch.

Flexible tube 47 supplies pressurized water to three branch tubes 50, 52 and 54 that lead to the various spray nozzles 34,36 and 38. Various T connectors 49 provide connections between the various tubes. The system is designed so that each pair of nozzles 34,36 and 38 receives its water supply through a separate branch tube, such that the water pressure at each nozzle is approximately the same. Each nozzle handles approximately the same water quantity (assuming) the same pressure drop through each nozzle).

Figure 4:
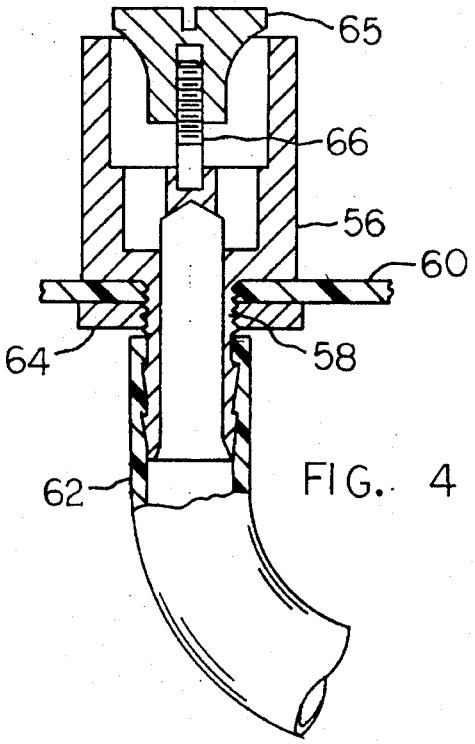
FIG. 4 shows a water spray nozzle unit that can be used in the FIG. 1 mist generating system.

FIG. 4 shows a preferred mounting arrangement for each spray nozzle. Nozzle housing 56 has a threaded tubular section 58 extending through a drilled hole in rigid wall 60 of the lounge chair to telescopically receive the flexible tube 62. Tube 62 is representative of the various branch tubes depicted in FIG. 2. Wall 60 is representative of the rigid wall structures that form seat portion 12, back portion 14, and arm rests 26. All of the six spray nozzles (34,36 and 38) can be contructed and mounted, as shown in FIG. 4.

The threaded area of tubular section 58 receives a fastener nut 64, whereby the spray nozzle is rigidly fastened to the associated wall 60. Hydrodynamic forces will not disturb the spray nozzle, so that the spray pattern and trajectory are predictable and non-varying (for a given water pressure and nozzle setting).

Each spray nozzle can be a conventional structure having a flow constricting member 65 threaded onto a threaded post 66 located within housing 56, whereby the size of the annular flow opening around the edge of member 65 can be varied to adjust the spray pattern. A screw driver slot is provided in member 65 for adjustment purposes.

Figure 5:
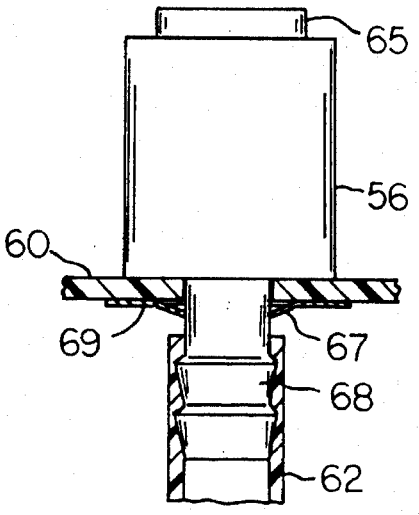
FIG. 5 is a view taken in the same direction as FIG. 4, but showing an alternate mechanism for mounting the water spray nozzle unit.

FIG. 5 shows an alternate way to mount the spray nozzle on wall 60. An annular spring steel fastener 69 has plural spring fingers 67 grippably engaged with the side surface of the nozzle tubular section 68, whereby the spray nozzle is immovably affixed to wall 60. FIG. 4 and 5 illustrate alternate mechanisms for affixing the spray nozzle to rigid wall 60.

Figure 6:
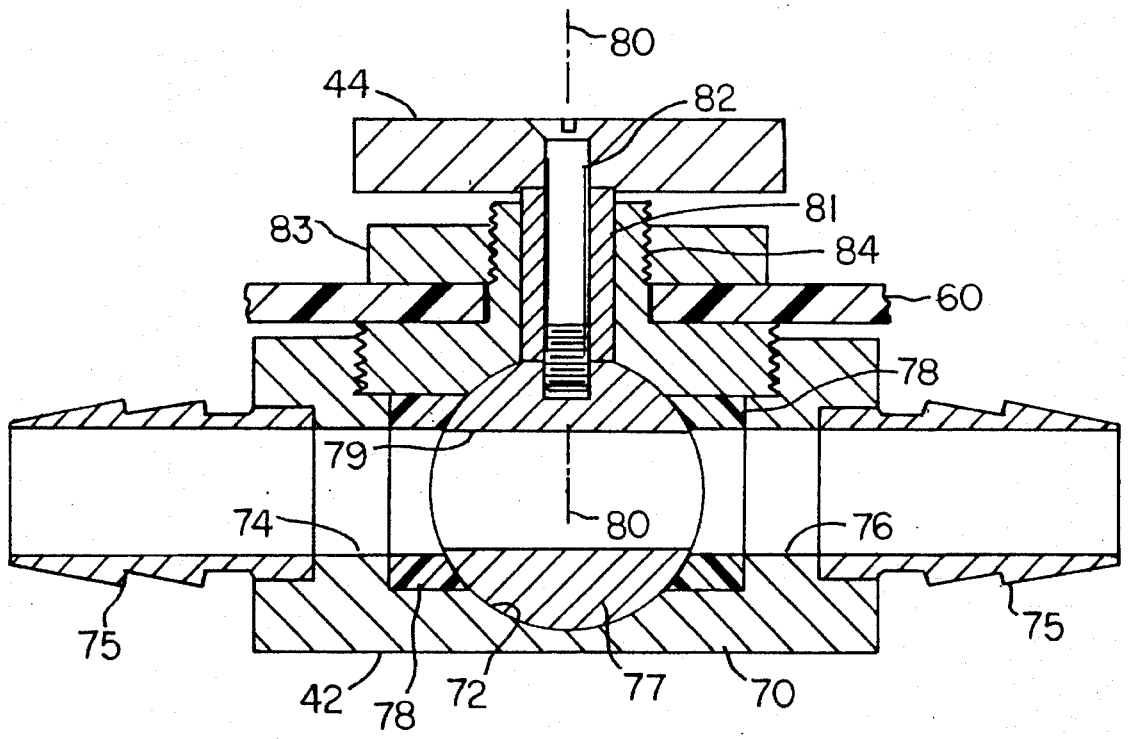
FIG. 6 shows a ball valve that can be used for controll-water flow in the FIG. 1 mist generating system.

FIG. 6 shows some features of a control valve 42 that can be employed in the FIG. 1 lounge chair to control water flow to the various water spray nozzles 34,35 and 38. As shown in FIG. 6 the control valve comprises a valve housing 70 having a spherical cavity 72 located between an inlet port 74 and an outlet port 76. A ball-shaped (spherical) valve element 77 is seated within cavity 72 for controlling the flow of water from port 74 to port 76. Conventional seals 78 are provided to prevent water leakage. Ribbed tubular connectors 75 can be secured to the valve housing to receive hoses 40 and 46 (FIG. 2).

Valve element 77 has a diametrical flow passage 79 that can have varying degrees of registration with ports 74 and 76, depending on the valve element position relative to turning axis 80. A handle 44 is connected to spherical valve element 77 via a tubular stem 81 and attachment screw 82, whereby the valve element 77 can be rotated around axis 80.

As shown in FIG. 6, the valve element 77 is in the fully opened position, wherein the maximum flow of water is achieved through the valve. When handle 44 is turned ninety degrees around axis 80 the flow passage 79 is completely isolated from ports 74 and 76, so that the valve is in the fully closed position. At various intermediate positions of handle 44 (between the illustrated position and the ninety degree position) the passage 79 has varying degrees of registration with ports 74 and 76, such that various water flow rates through the valve can be obtained.

Control valve 42 is rigidly affixed to the lounge chair so as to be supported against water hammer forces. As shown in FIG. 6, a nut 83 can be screwed onto threaded section 84 of the valve housing to secure the valve to chair wall 60.

Valve 42 can be used as an on-off control, and also as a flow rate control to adjust the spray patterns at the various nozzle units 34,36 and 38. Also, the individual nozzles can be adjusted, using the screw driver slot in the respective flow constrictor 65, as explained above.

The various spray nozzles are arranged to provide a reasonably complete saturation of the entire area above the lounge chair. Nozzles 34 are arranged to have vertical (upward) conical trajectories at the foot end of the lounge chair. Nozzles 36 are mounted to have conical trajectories directly away from the surface of back portion 14, i.e. over the shoulders of the person reclining on the lounge chair. Nozzles 38 are arranged to discharge conical spray patterns from the respective arm rests 26 directly onto the body of the person occupying the chair.

Each spray nozzle is preferably constructed so that it can be turned off, if so desired, e.g. by turning flow constrictor 65 (FIG. 4) so that the annular flow passage is completely closed. The person occupying the chair can thus have a choice as to the quantity and location of the cooling mist.

It will be understood that the various hoses and flexible tubes used to supply water to the spray nozzles will be located in concealed positions underneath or behind the lounge chair exposed surfaces. The hoses and flexible tubes can be located within the various channels, depicted at 30, 32 and 24 in the drawings.

Since valve 42 and the six nozzle units are rigidly affixed to the chair walls, movement or vibration of the flexible tubes does not adversely affect the water spray actions. The flexible tubes are supported by the nozzle units, and have sufficient flexibility as to permit adjustment of the chair back portion 14 around hinges 18 without stressing the tubes.

The drawings necessarily show a specific structural arrangement embodying the invention. However, it will be appreciated that the invention can be carried out in various forms and structural configurations.

What is claimed is:

1. A sunbathing apparatus, comprising:

a lounge chair that includes a seat portion formed of a rigid panel, a back portion formed of a rigid panel, and two arm rests formed of a rigid panel;

first and second spray nozzle units affixed to said seat portion for spraying zones proximate to the feet of a person seated on the chair;

third and fourth spray nozzle units affixed to said back portion for spraying zones proximate to the shoulders of a person seated on the chair;

fifth and sixth spray nozzle units affixed to said arm rests for spraying zones proximate to the waist of a person seated on the chair;

each of said spray nozzle units comprising a tubular section extending through a rigid wall of one of said rigid panels of the chair, and fastener means on said tubular section, whereby the respective spray nozzle unit is rigidly affixed to the chair; and a water supply means for supplying pressurized water to said spray nozzle units; said water supply means comprising a series of flexible tubes telescopically connected to the tubular sections of the spray nozzle units;

said spray nozzle units being anchored to the chair so that hydronamic flexure of the tubes cannot disturb the spray nozzle units.

2. The sunbathing apparatus of claim 1, wherein each said fastener means comprises an internally threaded nut.

3. The sunbathing apparatus of claim 1, wherein said water supply means comprises first and second hoses, and a water control valve having an inlet connection to said first hose and an outlet connection to second hose; and means for rigidly affixing said control valve to the seat portion of the chair.

4. The sunbathing apparatus of claim 3, wherein said control valve is a ball valve that includes a valve housing having inlet and outlet ports and a spherical cavity between said ports, said valve further comprising a spherical valve element in said cavity; said spherical valve element having a straight diammetrical passage partially registerable with said inlet and outlet ports, whereby the valve element can be turned to different adjusted positions for varying the water flow through the valve.

5. The sunbathing apparatus of claim 1, wherein said flexible tubes are interconnected to form a first branch tube means connected to said branch first and second spray nozzle units, a second branch tube means connected to said third and fourth spray nozzle units, a third branch tube means connected to said fifth and sixth spray nozzle units.

6. The sunbathing apparatus of claim 5, wherein the tubes in each branch tube means are connected together by a T connector.

* * * * *